US008026859B2

(12) United States Patent
McLean

(10) Patent No.: US 8,026,859 B2
(45) Date of Patent: Sep. 27, 2011

(54) HORN ANTENNA WITH INTEGRATED IMPEDANCE MATCHING NETWORK FOR IMPROVED OPERATING FREQUENCY RANGE

(75) Inventor: James S. McLean, Austin, TX (US)

(73) Assignee: TDK Corporation, Chiba (JP)

( * ) Notice: Subject to any disclaimer, the term of this patent is extended or adjusted under 35 U.S.C. 154(b) by 690 days.

(21) Appl. No.: 12/187,526

(22) Filed: Aug. 7, 2008

(65) Prior Publication Data

US 2010/0033391 A1 Feb. 11, 2010

(51) Int. Cl.
*H01Q 13/10* (2006.01)

(52) U.S. Cl. ..... 343/786; 343/787; 343/860; 343/862; 343/772; 343/850; 343/863

(58) Field of Classification Search ..... None
See application file for complete search history.

(56) References Cited

U.S. PATENT DOCUMENTS

| | | | | |
|---|---|---|---|---|
| 4,157,550 | A | 6/1979 | Reid et al. | |
| 5,325,105 | A * | 6/1994 | Cermignani et al. | 343/786 |
| 6,208,309 | B1 | 3/2001 | Chandler et al. | |
| 6,208,310 | B1 | 3/2001 | Suleiman et al. | |
| 6,320,554 | B1 | 11/2001 | Yuanzhu | |
| 6,396,453 | B2 | 5/2002 | Amyotte et al. | |
| 6,489,931 | B2 | 12/2002 | Liu | |
| 6,995,728 | B2 | 2/2006 | Rodriguez | |
| 7,161,550 | B2 | 1/2007 | McLean et al. | |
| 2002/0113746 | A1 | 8/2002 | Strickland | |
| 2002/0186174 | A1 | 12/2002 | Matsumoto et al. | |
| 2003/0058182 | A1 | 3/2003 | Bhattacharyya et al. | |
| 2003/0210197 | A1 | 11/2003 | Cencich et al. | |
| 2008/0246682 | A1 | 10/2008 | McLean | |
| 2009/0167622 | A1 * | 7/2009 | Yanagisawa et al. | 343/772 |
| 2010/0220023 | A1 * | 9/2010 | Ge et al. | 343/772 |

* cited by examiner

*Primary Examiner* — Trinh Dinh
(74) *Attorney, Agent, or Firm* — Kevin L. Daffer; Daffer McDaniel, LLP

(57) ABSTRACT

A dual- or quad-ridged horn antenna with an embedded impedance matching network is provided herein. According to one embodiment, the horn antenna may include at least one pair of ridges arranged opposite one another for guiding an electromagnetic wave there between. A transmission line is coupled to a first one of the ridges for supplying power to, or receiving a signal from, a feed region of the horn antenna. To reduce impedance mismatches between the transmission line and the ridges, an impedance matching network is embedded within a second one of the ridges at the feed point. The impedance matching network reduces impedance mismatch and extends the operational frequency range of the horn antenna by providing a sufficient amount of series capacitance between the transmission line and the ridges at the feed region. As set forth herein, the impedance matching network is preferably implemented as an open-circuit transmission line stub or capacitive stub.

26 Claims, 16 Drawing Sheets

HORN ANTENNA WITH INTEGRATED IMPEDANCE MATCHING NETWORK FOR IMPROVED OPERATING FREQUENCY RANGE

BACKGROUND OF THE INVENTION

1. Field of the Invention

This invention relates to antenna design and, more particularly, to broadband horn antennas with integrated impedance matching networks.

2. Description of the Related Art

The following descriptions and examples are not admitted to be prior art by virtue of their inclusion within this section.

An antenna is a device which can radiate or receive electromagnetic (EM) energy. An ideal transmitting antenna receives power from a source (e.g., a power amplifier) and radiates the received power into space. That is, electromagnetic energy escapes from the antenna and, unless reflected or scattered, does not return. A practical antenna, however, generates both radiating and non-radiating EM field components. An example of a non-radiating EM field component would be the portion of the accepted power that is returned to the source, or otherwise dissipated in a resistive load.

The performance of an antenna can be characterized in a variety of ways. First, the radiation efficiency of an antenna (or "antenna efficiency") can be defined as the ratio of the amount of power radiated by the antenna to the amount of power accepted by the antenna (from a power source). The portion of the power accepted by the antenna, but not radiated, may be dissipated in the form of heat. Other antenna performance characteristics include radiation pattern, operating frequency bandwidth, gain and directivity.

As used herein, the "radiation pattern" of an antenna may be defined as the spatial distribution of a quantity, which characterizes the electromagnetic field generated by the antenna. The radiation pattern is usually given as a representation of the angular distribution (in spherical coordinates, $\theta$ and $\phi$, at a fixed radial distance, R, from the antenna) of one of the following quantities: power flux density, radiation intensity, directivity, gain, phase, polarization or field strength (electric or magnetic). The directivity, gain and polarization of an antenna can be computed with knowledge of the antenna's radiation pattern.

For example, the "directivity" of an antenna may be defined as that in the direction of maximum radiation. For most directional antennas, the radiation pattern includes one main lobe (pointing in the direction of maximum radiation) and several smaller side lobes (due, e.g., to reflections or cross-polarizations within the antenna). The side lobes tend to detract from the overall performance of the directional antenna by reducing the amount of EM energy radiated in the intended direction.

The "gain" of a directional antenna may be defined as the directivity multiplied by the radiation efficiency of the antenna. As such, the antenna gain will be less than the directivity for real antenna designs, which provide less than 100 percent radiation efficiency.

Electromagnetic fields are vector fields. The behavior of the vector nature of an electromagnetic field is often referred to as the "polarization" or "polarization state" of an antenna. Most antenna designs used for Electromagnetic Compatibility (EMC) testing are linearly polarized. A dual-ridged horn antenna, or tapered dual-ridged waveguide, is one example of a linearly polarized antenna in that the electromagnetic field produced by the horn on the principal axis and in the principal planes is linearly polarized. When heavily loaded, a dual-ridged horn antenna may be capable of providing a rather large operating frequency bandwidth (e.g., from about 1 GHz to about 18 GHz). The "operating frequency bandwidth" is typically defined as the range of frequencies which provide acceptable performance.

One embodiment of a dual-ridged horn antenna 100 is shown in FIGS. 1 and 2. In the illustrated embodiment, the dual-ridged horn antenna includes a pair of antenna elements 110 (otherwise referred to as "ridges" or "fins") arranged opposite one another within a rectangular-shaped housing. Each antenna element 110 is formed having a substantially convex inner surface 112 and a substantially straight outer surface 114. The outer surfaces 114 of the antenna elements are fixedly attached to walls 120 of horn antenna 100. When coupled together, walls 120 form a rectangular-shaped cone structure having a substantially larger aperture 130 than base 140. In some cases, a rectangular-shaped box (or "cavity structure") 150 may be coupled to the similarly shaped base 140. The cavity structure 150 is typically included to provide a shunt inductance behind the feed region of the horn antenna. The shunt inductance provides high-pass matching at the feed region and prevents energy from radiating out the back of the antenna.

As shown in FIG. 1, one or more power connectors 160 may be coupled to base 140 for supplying electrical current from a power source (not shown) to the antenna elements 110 via a coaxial transmission line (not shown). A conductive feed line 170 is included for transferring the electrical current from the coaxial transmission line to the antenna elements 110. The transition from the coaxial transmission line to the conductive feed line 170 is an important part of the horn in that it comprises part of the horn's feed region (i.e., the region or point at which power is supplied to the antenna elements). When power is supplied to the feed region, electromagnetic energy is generated and radiated out of the horn antenna. The inner surfaces 112 of antenna elements 110 are configured to guide the radiated energy as it travels from base 140, through the "throat" of the horn antenna, and out through the "mouth" or aperture 130 of the antenna.

As indicated above, some dual-ridged horn antennas are capable of operating over a rather large frequency range. For instance, some dual-ridge horn antennas used in EMC test systems are capable of providing approximately 1-18 GHz of operating frequency bandwidth. However, conventional dual-ridged horn designs are currently unable to provide a useable radiation pattern over a bandwidth significantly greater than 18:1. The bandwidth limitation is further exacerbated in quad-ridged horn designs.

A quad-ridged horn antenna is basically a dual-polarized version of a dual-ridged horn antenna and functions, in the ideal case, by exploiting the orthogonality of two modes in the quad-ridged waveguide. By maintaining the proper relation between the phases and amplitudes of the incident signals at the two ports of the quad-ridged waveguide, it is possible to produce circularly polarized far fields. More commonly such an antenna is used with a switch to provide two orthogonal linear polarizations.

In a practical situation, coupling between the two modes, especially in the feed region, is inescapable and detracts from the quad-ridged horn antenna's performance. Because of various difficulties in implementing the feed region (e.g., space constraints), quad-ridged horns have not been able to provide the same bandwidth as dual-ridged, single-polarization horns. At best, conventional quad-ridged horn antennas may provide an operating frequency range of about 1 GHz to about 10 GHz.

A need, therefore, exists for improved dual-ridged and quad-ridged horn designs that extend the usable operating frequency range beyond that which is currently available.

SUMMARY OF THE INVENTION

The problems outlined above may be in large part addressed by a dual- or quad-ridged horn antenna including at least one pair of ridges arranged opposite one another for guiding an electromagnetic wave there between. A transmission line is coupled to a first one of the ridges for supplying power to, or receiving a signal from, a feed region of the horn antenna. To reduce impedance mismatches between the transmission line and the ridges, an impedance matching network is embedded within a second one of the ridges at the feed region. In general, the impedance matching network may be configured for reducing mismatch by providing a series capacitance between the transmission line and the ridges at the feed region.

In one embodiment, the impedance matching network may include a conductive pin, which extends from the transmission line, through the first ridge and into a notch formed within the second ridge. The series capacitance needed at the feed region to reduce impedance mismatch is provided by the portion of the conductive pin, which is embedded within the notch. The embedded portion of the conductive pin may be otherwise referred to as an "open-circuit transmission line stub" or "capacitive stub." As set forth herein, the diameter and/or length of the capacitive stub may be increased to increase the amount of capacitance provided by the stub.

In some cases, the conductive pin may simply be an extension of a center conductor of the transmission line, such that a diameter of the conductive pin is substantially equal to a diameter of the center conductor. In other cases, the conductive pin may be distinct from, but attached to, a center conductor of the transmission line. This may allow the conductive pin to have a substantially larger diameter than that of the center conductor. In one example, the conductive pin may comprise a continuous conductor having a constant, albeit larger, diameter. In another example, the conductive pin may be formed in two separate portions, which are later coupled together. For instance, the conductive pin may include a first portion, which extends from the transmission line, through the first ridge and up to a boundary of the notch. The conductive pin may also include a second portion directly connected to the first portion and confined within the notch. In some cases, a diameter of the second portion may be larger than a diameter of the first portion.

In some embodiments, the impedance matching network may include a dielectric material for securing the conductive pin at the feed region and preventing physical contact between the conductive pin and the ridges. In some cases, the dielectric material may extend from the transmission line, through the first ridge and into the notch formed within the second ridge. In other cases, the dielectric material may be confined within the notch for encasing a terminal end of the conductive pin. In either case, the dielectric material may be included for increasing the amount of capacitance provided by the stub. In order to provide a sufficient amount of capacitance, the dielectric material may be selected from a group of dielectric materials having a relative permittivity greater than or equal to about 2.0. For example, the dielectric material may be selected from a group of dielectric materials comprising synthetic fluoropolymers, cross-linked polystyrenes and ceramic materials.

A method for fabricating a horn antenna is also contemplated herein. In general, the method may include providing a pair of ridges, so that inner surfaces of the ridges are positioned for guiding electromagnetic energy there between. In some cases, the method may continue by inserting a conductive pin through a hole extending through a first one of the ridges. The conductive pin may be configured as set forth herein. Next, one end of the conductive pin may be connected to a power connector or input/output (I/O) connector of the horn antenna. In some cases, the conductive pin and connector assembly may be advanced through the hole until a terminal end of the conductive pin is located within a notch formed within a second one of the ridges and the connector is substantially flush with an outer surface of the first one of the ridges. In other cases, a dielectric material or "dielectric plug" may be inserted within the notch before the conductive pin and connector assembly are advanced through the hole. If included, the dielectric plug may be configured for securing the terminal end of the conductive pin within the notch, preventing physical contact between the conductive pin and the ridges and increasing the series capacitance provided by the portion of the conductive pin embedded within the notch.

BRIEF DESCRIPTION OF THE DRAWINGS

Other objects and advantages of the invention will become apparent upon reading the following detailed description and upon reference to the accompanying drawings in which.

Figure 1:
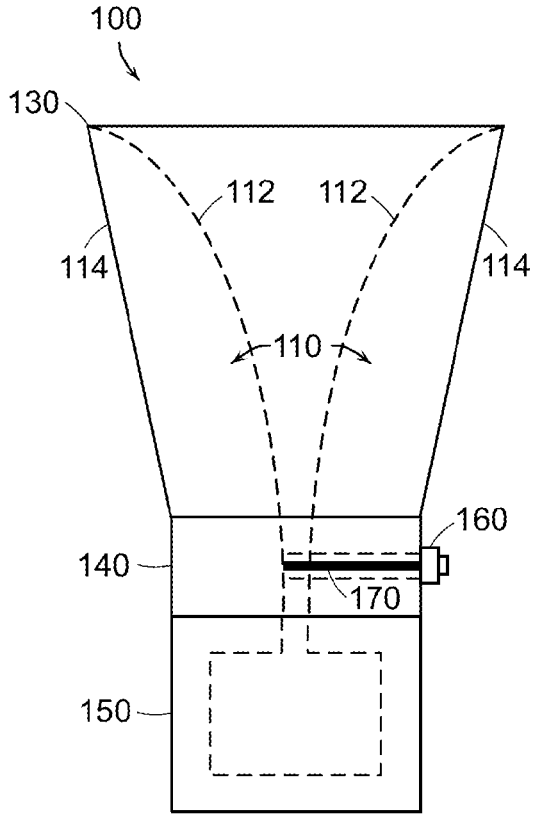
FIG. 1 is a side view of a conventional dual-ridged horn antenna.
Figure 2:
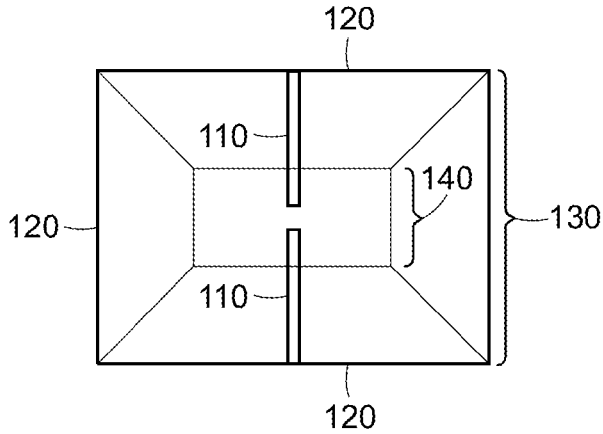
FIG. 2 is a top view of a conventional dual-ridged horn antenna.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF PREFERRED EMBODIMENTS

Turning to the drawings, exemplary embodiments of a dual-ridge horn antenna are shown in FIGS. 3 and 5. As will be described in more detail below, the antenna design provided herein improves upon conventional designs by embedding an impedance matching network within at least one "ridge" of a dual- or quad-ridged horn antenna. The impedance matching network improves the operating frequency range at the low end by reducing impedance mismatch between the coaxial transmission line and the ridge(s) at the feed point. In a general embodiment, the impedance matching network may include a conductive feed line or conductive pin, which extends from the coaxial transmission line, through a first one of the ridges and into a notch formed within a second one of the ridges. The length and diameter of the conductive pin may be chosen, so that the conductive pin does not make physical contact with the ridges, but instead, couples indirectly through capacitive coupling. In some embodiments, a dielectric material may be included within the notch for increasing the capacitive coupling and securing the conductive pin within the notch.

It should be understood that the impedance matching network described above may be combined with other broadband horn antenna improvements. Such improvements may be set forth herein or may be disclosed in various patents and patent applications assigned to the present inventor. For instance, the improvements noted herein may be combined with one or more of the improvements set forth in commonly assigned U.S. Pat. No. 7,161,550. However, it may not be necessary to include all disclosed improvements in all embodiments of the invention. Instead, some embodiments of the invention may include only one, or possibly several, of the improvements set forth above. One skilled in the art would readily understand how various aspects of the invention could be combined to produce alternative embodiments, which may not be explicitly shown in the drawings or described herein. The invention is intended to cover all such possible combinations.

Figure 3A:
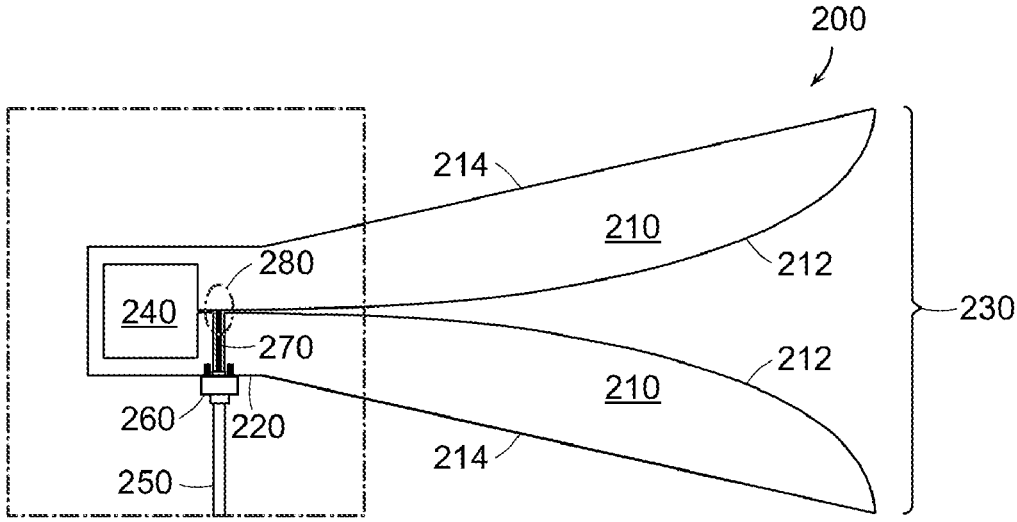
FIG. 3A is a cross-sectional view illustrating an embodiment of a dual-ridged horn antenna, wherein the conductive feed line couples to the waveguide with a direct ohmic connection.

FIG. 3A is a cross-sectional view of a horn antenna 200 having at least two "ridges" or "fins" 210 positioned opposite one another for guiding electromagnetic (EM) energy radiated from, or received by, the horn antenna. The ridges 210 may have substantially any geometry deemed appropriate for "guiding" EM waves through the antenna. For instance, the ridges may have curved inner surfaces 212 and substantially straight outer surfaces 214, as shown in FIG. 3A. Though the configuration of the outer surfaces is somewhat less important (and may be straight to simplify the design), the contour of the inner surfaces preferably functions to guide or direct the electromagnetic energy radiated from the horn antenna. Other ridge geometries not specifically described herein may also be used. Once a geometry is decided upon, the ridges may be constructed from substantially any conductive material. Aluminum is one example of a material that may be used to construct the ridges. Other materials not specifically mentioned herein may also be used.

In one embodiment, the ridges may be formed as individual conductive plates, which are assembled together in the described manner. In another embodiment, an outline of the two ridges positioned opposite one another may be cut or otherwise formed as a continuous piece of conductive material. If two ridges are included, as shown in FIG. 3A, the ridges may be combined with other antenna components (discussed below) to form a dual-ridged horn antenna or dual-ridged waveguide. Although not specifically illustrated herein, a quad-ridged horn may be provided by positioning two double-ridged horns together, such that adjacent ridges are arranged or formed substantially 90° apart. The quad-ridged horn typically has two input/output ports.

Regardless of whether a dual-ridged or quad-ridged horn is provided, ridges 210 may be configured so that they are closely coupled at a base 220 of the antenna and curve away from one another to form a slightly larger aperture 230. In some embodiments, a rectangular-shaped box (or "cavity structure") 240 may be integrally formed, or otherwise coupled to, the similarly shaped base 220. If included, the cavity structure may be configured to provide a shunt inductance behind the feed region of the horn antenna. The shunt inductance prevents energy from radiating out the back of the horn antenna and contributes to the impedance matching network located at the feed region. The cavity structure may be further configured as described herein.

As shown in FIG. 3A, at least one connector 260 may be coupled to the base 220 of antenna 200. In general, connector 260 may be coupled for supplying power to, or receiving a signal from, ridges 210. In a transmitting mode, connector 260 may be coupled for supplying electrical current from a power source (not shown) to the ridges 210 via a coaxial transmission line 250. In a receiving mode, connector 260 may be coupled for receiving the electrical current generated by the ridges upon receiving a radiated signal. Connector 260 may be considered a "power connector" or "input/output connector." If one connector is used, a conductive feed line or "conductive pin" 270 may be used to transfer the electrical current between coaxial transmission line 250 and ridges 210 at the feed region 280. As used herein, the "feed region" is the point at which power is supplied to the ridges.

Figure 3B:
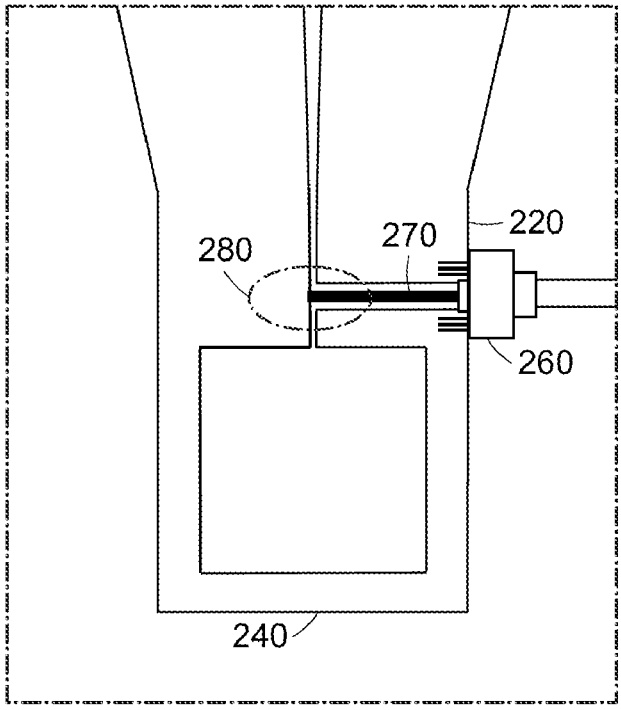
FIG. 3B is a zoomed-in cross-sectional view of the base portion of the dual-ridged horn antenna shown in FIG. 3A.

In FIGS. 3A and 3B, the conductive pin 270 extends from connector 260, through a first one of the ridges, between a gap separating the first and second ridges, and up to an inner surface 212 of the second ridge. One end of the conductive pin 270 is connected to connector 260 for transferring the electrical current to/from the coaxial transmission line 250. Another end (i.e., the "terminal end") of the conductive pin is connected to the inner surface 212 of the second ridge for transferring the electrical current to/from the feed region 280. More specifically, the terminal end of conductive pin 270 is configured for making direct, physical contact with the inner surface 212 of the second ridge. Such contact may be realized by soldering the terminal end of the conductive pin to the inner surface 212 of the ridge at the desired feed point.

Although adequate for some applications, the embodiment shown in FIGS. 3A and 3B may not provide an optimum solution for all applications. For example, although the current embodiment provides a significantly broad bandwidth (e.g., about 18:1), the operating frequency range is limited at the upper and lower ends by two primary mechanisms. This may be undesirable in some very broadband applications (i.e., those exceeding 18:1 bandwidth).

At the low end, the operating frequency range is limited by the geometry of the waveguide (i.e., the geometry of the ridges), as well as the size and geometry of the cavity 240 located behind the feed. For example, the dual-ridged waveguide shown in FIGS. 3A and 3B tends to degenerate into a DC short circuit (i.e., a near-zero input impedance) when the operating frequency falls below the cut-off frequency of its fundamental mode. The cavity structure 240 also degenerates into a DC short circuit at sufficiently low frequencies. However, the coaxial transmission line 250 provides a non-zero input impedance (typically about 50Ω) to the feed region 280. This produces a significant impedance mismatch at the feed, which limits the low end of the operating frequency range.

At the high end of the operating frequency range, the cavity 240 behind the feed will exhibit a resonance which provides a near short circuit input impedance at the feed. To be more specific, the cavity 240 will exhibit a number (actually an infinite number) of resonances as the operating frequency of the horn is increased without limit. The particular resonance of interest is not the fundamental resonance, which is an open circuit resonance, but rather the particular mode that exhibits an electric field null near the feed point. This mode places a pronounced notch in the frequency response of the horn (shown, e.g., in FIGS. 4A and 4B), which limits the high end of the operating frequency range. The notch can also be seen in the input return loss of the horn (not shown), since essentially all of the input power is reflected by the near zero input impedance.

In some cases, the frequency at which the notch occurs can be increased by reducing the size of the cavity behind the feed region. However, this tends to undermine the low frequency response by increasing impedance mismatch at the feed. That is, when the size of the cavity is reduced, the equivalent shunt inductance representing the cavity well below its fundamental resonance is reduced. The decrease in shunt inductance limits the low frequency response of the horn antenna by causing the input impedance seen by the feed to degenerate into a short circuit at a higher frequency than it would have done with a larger sized cavity.

Figure 4A:
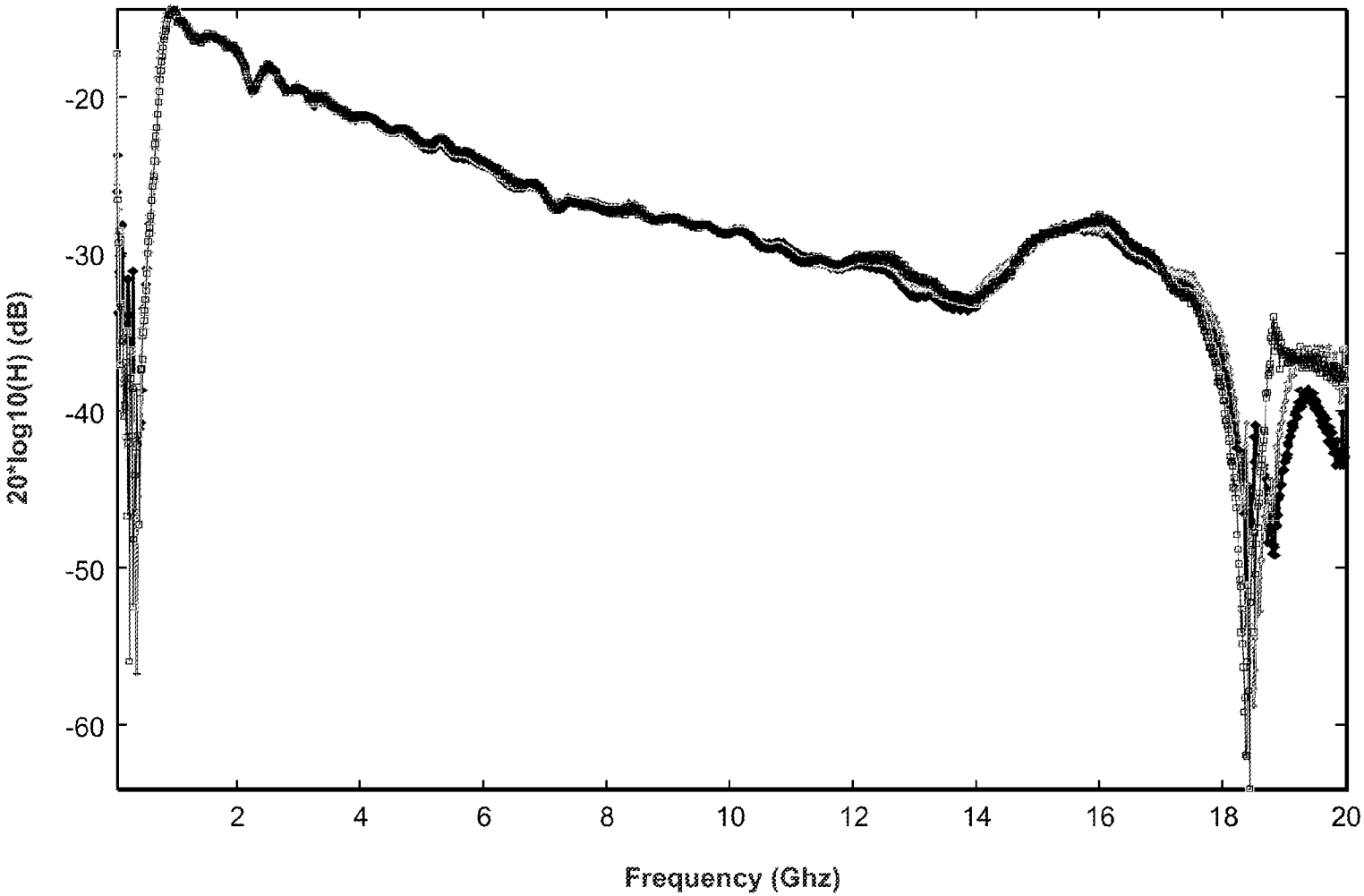
FIG. 4A is a graph illustrating the magnitude of the frequency transfer function provided by the dual-ridged horn antenna shown in FIGS. 3A-3B.
Figure 4B:
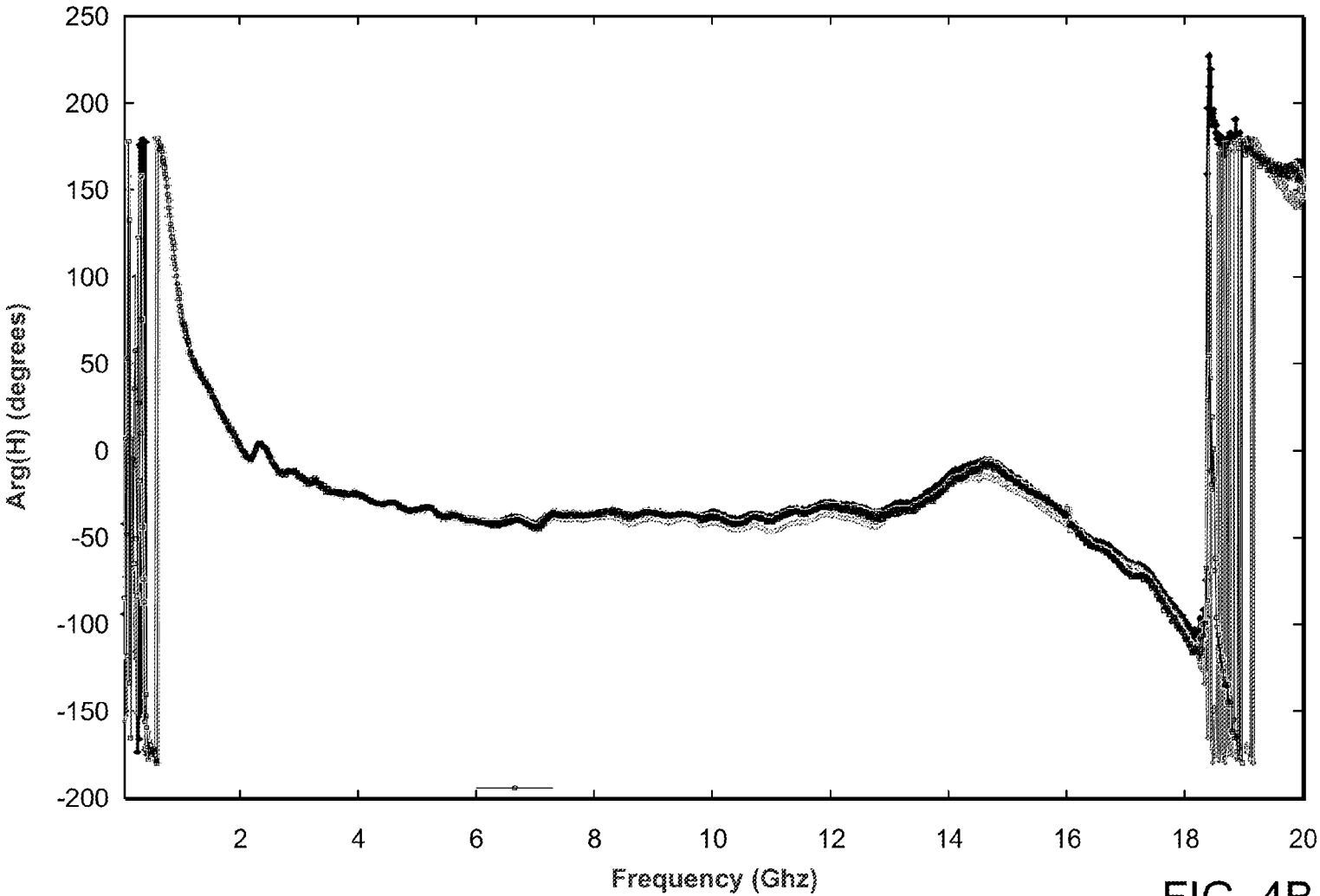
FIG. 4B is a graph illustrating the phase of the frequency transfer function provided by the dual-ridged horn antenna shown in FIGS. 3A-3B.

FIGS. 4A and 4B plot the magnitude and phase, respectively, of the frequency response provided by dual-ridged horn antenna 200. The graphs illustrate that, although the horn provides significantly large bandwidth (approximately 1-18 GHz), the upper and lower ends of the operating bandwidth are limited by several factors, including the behavior of the cavity behind the feed, and the resonances of the cavity that present low impedances at the feed (which cause reflections and, thus, reduces the radiated power).

In addition to limited bandwidth, the dual-ridged horn shown in FIGS. 3A and 3B provides a direct, physical connection between the conductive pin and ridges. This may be problematic for two reasons. First, the physical connection between the pin and ridges is somewhat difficult to fabricate. As noted above, the physical connection is typically made by soldering the terminal end of conductive pin 270 to the inner surface 212 of the second ridge. However, the conductive pin and ridge are often made from different materials (e.g., the conductive pin may be gold-plated brass or copper, while the ridge is aluminum), which may not produce a strong (or very conductive) bond when soldering techniques are used to connect the two surfaces. For matching purposes, it is essential that contact be made at the surface of the ridge as opposed to inadvertently producing a re-entrant coaxial hole with its attendant inductance.

Another problem with the direct, physical connection provided in FIGS. 3A and 3B is that any longitudinal force on the connector 260 can cause the socket of the connector to be displaced, in turn, causing an impedance mismatch at the connector. Even very high quality connectors have no tolerance for longitudinal force on the pins. This severely limits the means for making direct, physical contact between the conductive pin 270 and the second ridge.

Various embodiments of an improved dual-ridged horn antenna 300 are illustrated in FIGS. 5A-5F. In general, the dual-ridged horn antenna 300 shown in FIGS. 5A-5F improves upon previous antenna designs by embedding an impedance matching network within at least one "ridge" of the horn antenna. As set forth below, the impedance matching network improves the lower end of the operating frequency range by reducing (and/or eliminating) any impedance mismatch that may exist between the coaxial transmission line and the horn at the feed point. In some cases, the reduced mismatch may enable the high end of the operating frequency range to be extended, e.g., by decreasing the size of the cavity structure located behind the feed. Another advantage of the impedance matching network is that the network is implemented in a manner, which eliminates the need for making a direct, physical connection between the conductive pin and ridges. This greatly simplifies fabrication and eliminates mechanical and electrical perturbations caused, e.g., by longitudinal force on the connector.

Figure 5A:
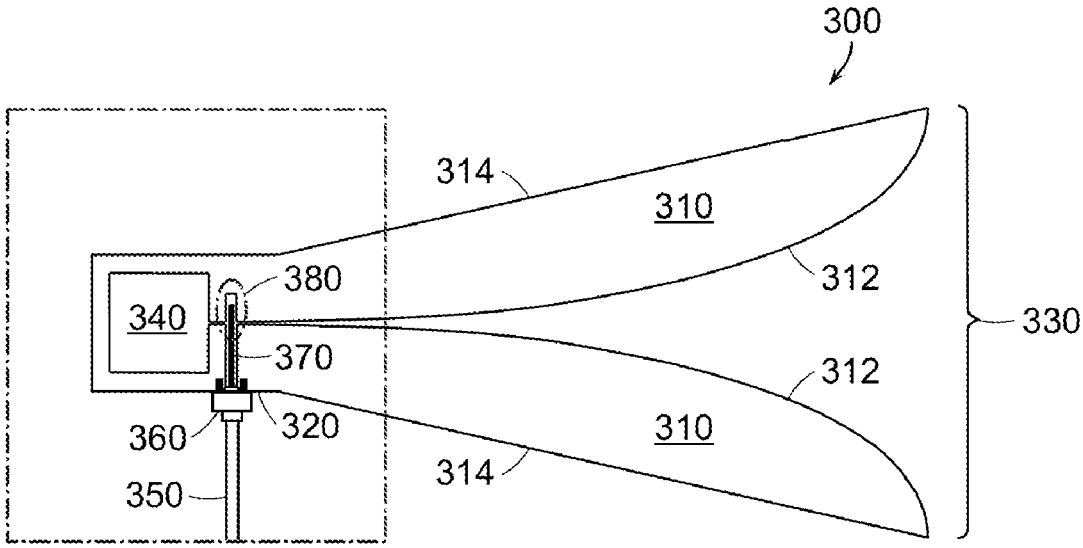
FIG. 5A is a cross-sectional view illustrating a preferred embodiment of a dual-ridged horn antenna, wherein the conductive feed line couples to the dual-ridged waveguide through indirect capacitive coupling.

In some embodiments, the horn antenna 300 shown in FIG. 5A may be similar to the horn antenna 200 shown in FIG. 3A. For instance, horn antenna 300 may include at least two ridges 310 positioned opposite one another for guiding electromagnetic (EM) energy radiated from, or received by, the horn antenna. As noted above, the ridges 310 may be formed from substantially any material and may have substantially any geometry deemed appropriate for "guiding" EM waves through the antenna. The ridges may be constructed as individual conductive plates, which are assembled together in the described manner, or may be formed as a continuous piece of conductive material. An appropriate number of ridges may be included to form a dual-ridged horn antenna, as shown in FIG. 5A, or a quad-ridged horn (not specifically shown herein).

Regardless of whether a dual- or quad-ridged horn is provided, ridges 310 are configured so that they are closely coupled at a base 320 of the antenna and curve away from one another to form a slightly larger aperture 330. In some embodiments, a rectangular-shaped box (or "cavity structure") 340 may be integrally formed, or otherwise coupled to, the similarly shaped base 320 for providing a shunt inductance behind the feed region of the horn. As noted above, the shunt inductance provides high pass matching at the feed region and prevents energy from radiating out the back of the antenna. The cavity structure may be further configured as described herein.

As shown in FIG. 5A, at least one connector 360 may be coupled to base 320 for supplying power to, or receiving a signal from, ridges 310. For instance, connector 360 may be coupled for supplying electrical current from a power source (not shown) to the ridges 310 via a coaxial transmission line 350 when the horn antenna is configured in a transmitting mode. As in the previous embodiment, a conductive feed line or "conductive pin" 370 is provided for transferring the electrical current from the coaxial transmission line 350 to the ridges 310 at the feed region 380. One end of the conductive pin 370 is connected to connector 360 for receiving the electrical current from the coaxial transmission line 350. Unlike the previous embodiment, however, the opposite end (i.e., the "terminal end") of the conductive pin 370 is not configured for making a direct, physical connection to the inner surface 312 of the second ridge.

Instead, conductive pin 370 extends from connector 360, through a first one of the ridges, between a gap separating the first and second ridges, and into a notch 390 formed within the second ridge. The "notch" may be formed in substantially any manner and may have substantially any geometrical configuration deemed appropriate. In one embodiment, the notch 390 may be formed by drilling a hole, which extends through the first ridge and into a portion of the second ridge. In another embodiment, the notch 390 and/or hole may be pre-fabricated within the initial ridge geometry (e.g., when the ridges are initially cut or molded).

Regardless of the manner in which the notch is formed, the notch and conductive pin may be configured, such that the conductive pin does not come in contact with the surface of the ridges 310. Instead of the direct, physical connection used in FIGS. 3A and 3B, the conductive pin 370 shown in FIGS. 5A-5F provides a capacitive connection between the coaxial transmission line 350 and the ridges 310 at the feed point 380. In other words, the portion of the pin 370 embedded within the notch constitutes an "open-circuit transmission line stub" or "capacitive stub," which provides a series capacitance between the coax transmission line and the ridges at the feed point. The series capacitance provided by the stub enables the current embodiment to provide the impedance matching needed to improve the operating frequency range at the low end.

In some embodiments, a relatively large capacitance may be needed to provide sufficient, but not excessive, capacitive reactance at the low end of the operating frequency range. An appropriately large capacitance may be obtained in several ways. First, if a re-entrant stub is used, a relatively large capacitance may be realized by making the inner ($d_i$) and outer ($d_o$) diameters of the re-entrant stub relatively close in value. This increases capacitive coupling (by maximizing surface area) and improves the matching at the feed point by reducing the characteristic impedance ($Z_{ostub}$) of the transmission line formed by the conductive pin 370 and its respective outer wall as shown, e.g., in EQ. 1.

For example, the characteristic impedance ($Z_{ostub}$) of the transmission line stub formed by the conductive pin 370 is given by:

$$Z_{0stub} = \frac{60}{\sqrt{\varepsilon_R}} \log\left(\frac{d_o}{d_i}\right) = \sqrt{\frac{L_l}{C_l}} \qquad \text{EQ. 1}$$

where $L_l$ and $C_l$ are the distributed inductance (H/m) and distributed capacitance (F/m) respectively. The stub exhibits a phase velocity of:

$$c_{phase} = \frac{1}{\sqrt{L_l C_l}} = \frac{1}{\sqrt{\varepsilon_0 \varepsilon_R \mu_0 \mu_R}}. \qquad \text{EQ. 2}$$

When the stub has an air dielectric, the relative permittivity and permeability are unity and the phase velocity is simply the speed of light in free space, $c_0$. Thus, the distributed capacitance ($C_l$) of the conductive pin 370 can be expressed as:

$$C_l = \frac{1}{c_{phase} Z_0} = \frac{1}{c_0 60 \log\left(\frac{d_o}{d_i}\right)} \qquad \text{EQ. 3}$$

EQ. 3 shows that making the inner ($d_i$) and outer diameters ($d_i$) of the conductive pin 370 close to one another increases the capacitance per unit length and lowers the characteristic impedance ($Z_{ostub}$) of the stub. This decreases the "driving point" or "input" impedance ($Z_{stub}$) of the stub, as shown in EQ. 4:

$$Z_{stub} = -jZ_{0stub} \cot\beta l = \frac{1}{j\omega C_{stub}} \qquad \text{EQ. 4}$$

The input impedance ($Z_{stub}$) shown in EQ. 4 is capacitive and equivalent to a capacitance of $C_{stub}$ when the stub is less than one-quarter wavelength long.

In some cases, the input impedance ($Z_{stub}$) to the capacitive stub (i.e., the portion of the conductive pin 370 embedded within the second ridge) may be reduced by increasing the length of the stub, as shown in EQ. 5.

$$Z_{stub} = -jZ_o \cot(\beta l_{stub}) \qquad \text{EQ. 5}$$

Although this increases the effective capacitance ($C_{stub}$) exhibited by the stub (see EQ. 4), lengthening the stub lowers the half-wave resonance frequency of the stub, or the frequency at which the open-circuit transmission line stub becomes a near open circuit. This lowers the upper frequency limit of the capacitive structure, which in turn, lowers the upper frequency limit of the horn antenna. To ensure that the upper frequency limit of the horn antenna is not affected, the length of the stub is preferably chosen, so that the half wave resonance is above the desired upper frequency limit of the horn antenna.

Since the ratio of inner-to-outer dimensions of the stub is typically limited by machining capabilities, limiting the length of the stub often limits the realizable capacitance provided by the stub. However, the capacitance may be increased, in some embodiments, by exploiting other forms of capacitance.

In practice, the capacitive stub 370 provides an effective capacitive, which may include three distinct components. First, the capacitive stub provides a distributed capacitance (discussed above) between the surface of the stub 370 and the surface of the notch 390 along the length of the stub. This form of capacitance is directly dependent on the length of the stub, and therefore, increases and decreases with length. In addition, the effective capacitance contains a parallel plate capacitance between the end of the stub 370 and the end of the inner surface of the notch 390. The parallel plate capacitance may be adjusted by increasing/decreasing the gap between opposing surfaces of the stub and notch. Finally, the effective capacitance contains a contribution from the fringing fields near the "corners" of the stub (referred to as "fringe capacitance"). In some cases, the fringe capacitance may be increased/decreased by providing the stub with sharper/rounder corners. Depending on the geometry and length of the stub, any one of these three contributions may be exploited to increase the effective capacitance of the stub.

Figure 5C:
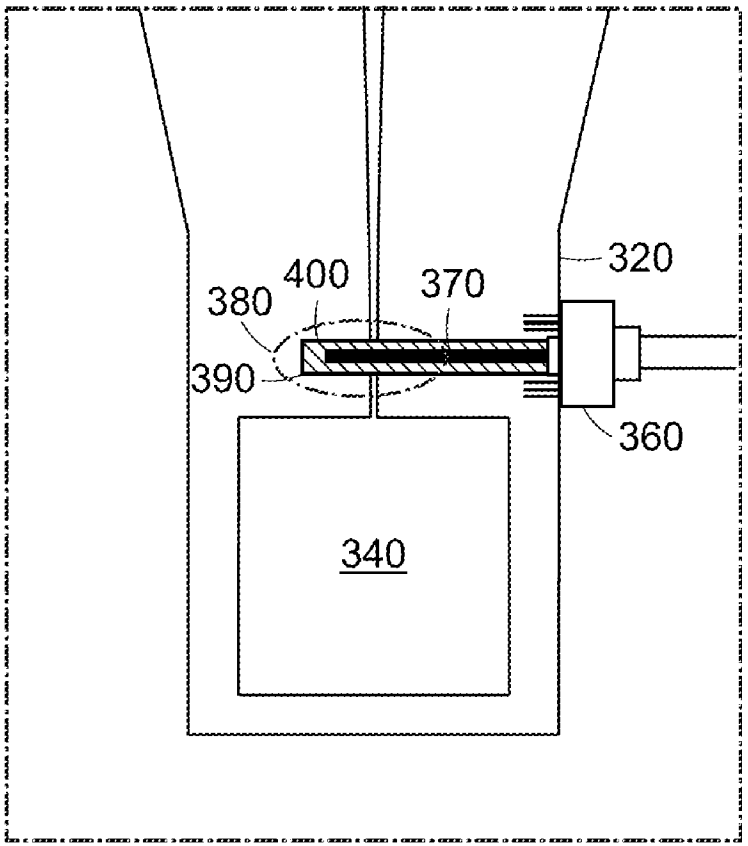
FIG. 5C is a zoomed-in cross-sectional view of the base portion of the dual-ridged horn antenna shown in FIG. 5A, illustrating an alternative embodiment of a dielectric material used to increase the capacitive coupling between the conductive feed line and dual-ridged the waveguide.
Figure 5B:
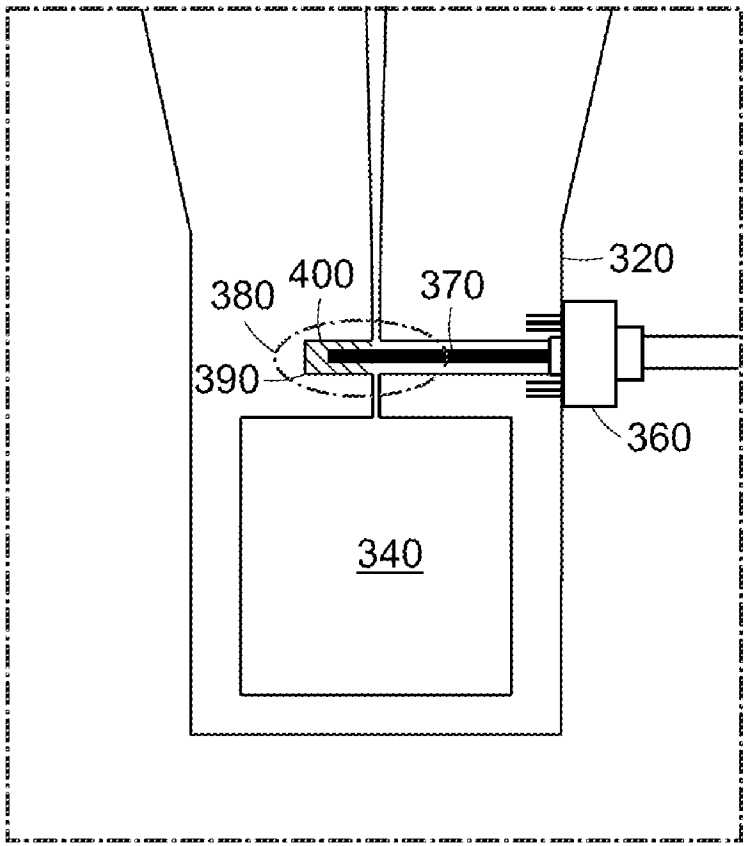
FIG. 5B is a zoomed-in cross-sectional view of the base portion of the dual-ridged horn antenna shown in FIG. 5A, illustrating one embodiment of a dielectric material used to increase the capacitive coupling between the conductive feed line and the dual-ridged waveguide.
Figure 5D:
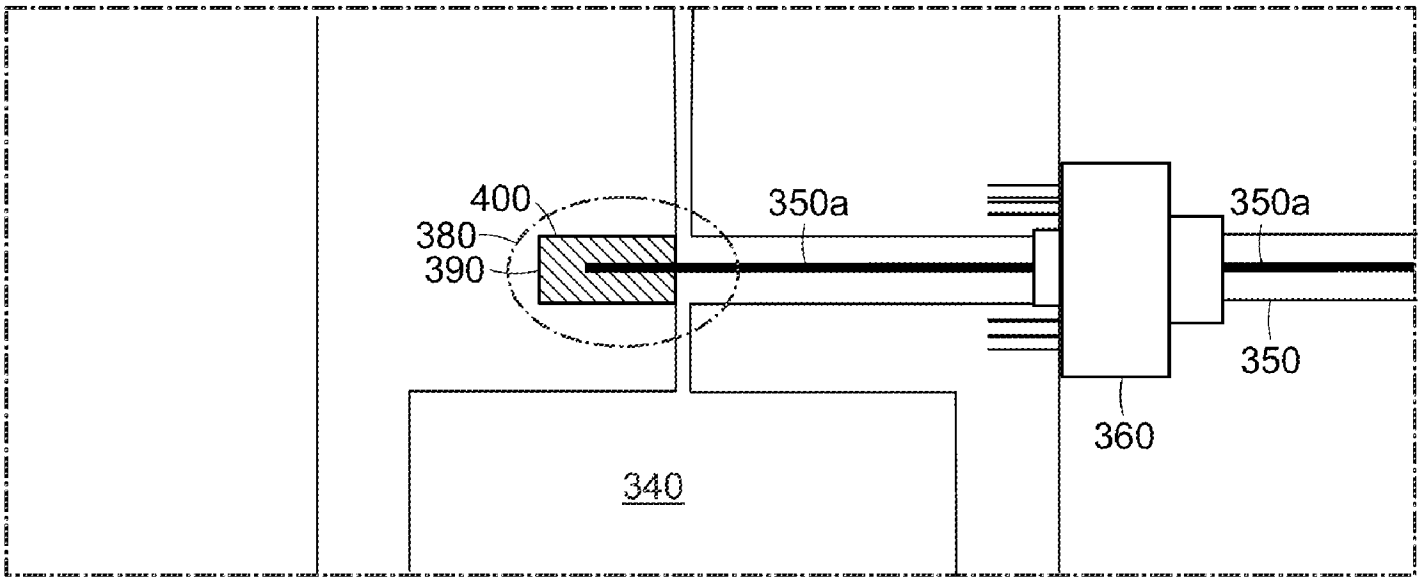
FIG. 5D is a zoomed-in cross-sectional view of the base portion of the dual-ridged horn antenna shown in FIG. 5A, illustrating one possible configuration for the conductive feed line (or "conductive pin")
Figure 5E:
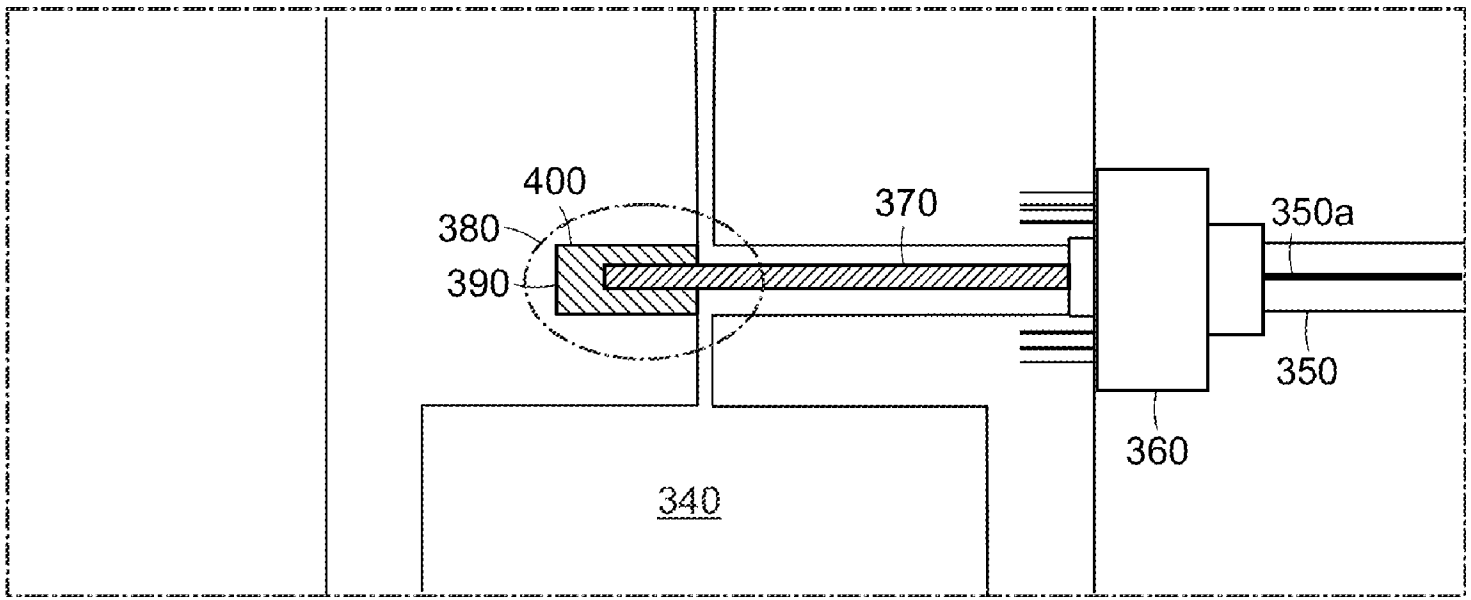
FIG. 5E is a zoomed-in cross-sectional view of the base portion of the dual-ridged horn antenna shown in FIG. 5A, illustrating another possible configuration for the conductive feed line (or "conductive pin")

In some embodiments, the capacitance may be further increased by adding a dielectric material to the capacitive structure as shown, e.g., in FIGS. 5B and 5C. In one example, the dielectric material 400 may be confined within the notch 390 formed within the second ridge, as shown in FIG. 5B. In another example, the dielectric material 400 extends through both the hole and the notch, as shown in FIG. 5C. In other words, the dielectric material may extend from connector 360, through the first ridge and into the notch 390 formed within the second ridge. Although either embodiment may be used, the embodiment shown in FIG. 5B may be preferred in that it is slightly more robust and avoids use of a dielectric material 400 within the gap (which would be somewhat detrimental).

In addition to securing the terminal end of the conductive pin 370 within the notch 390 and preventing physical contact between the conductive pin and the ridges 310, dielectric material 400 functions to increase the realizable capacitance of the capacitive stub by increasing the relative permittivity ($\in_R$) of the capacitive structure. A broad range of dielectric materials may be used. However, in order to provide sufficient capacitance, a dielectric material having a relative permittivity greater than about 2.0 may be preferred, in at least some embodiments of the invention. Possible candidates for dielectric material 400 include synthetic fluoropolymers (e.g., PTFE), cross-linked polystyrenes (e.g., Rexolite) and ceramic materials (e.g., alumina, beryllia, or barium titanate). Other dielectric materials not specifically mentioned herein may also be used.

As noted above, the length of the capacitive stub ($l_{stub}$) may be increased to reduce the input impedance ($Z_{stub}$) and increase the series capacitance provided by the stub. However, the stub length is not the only dimension that can be exploited to optimize capacitance, while ensuring that the half-wave resonance remains above the desired upper frequency limit of the horn antenna. As set forth below and shown in FIGS. 5D-5F, the diameter of the conductive pin 370 may also be exploited.

In some embodiments, conductive pin 370 may be a single conductor having a constant diameter that extends from conductor 360, through the first ridge and into the notch 390 formed within the second ridge. In one embodiment (see, e.g., FIG. 5D), the diameter of the conductive pin 370 may be substantially equal to the diameter of the center conductor 350*a* included within the coaxial transmission line 350. In such an embodiment, conductive pin 370 may simply be an extension of center conductor 350*a*. In another embodiment (see, e.g., FIG. 5E), the diameter of the conductive pin 370 may be substantially greater than the diameter of the center conductor 350*a*. Although such an embodiment would require conductive pin 370 to be electrically coupled to center conductor 350*a* at connector 360, a larger diameter pin 370 may be desired for increasing the capacitance of the stub. However, care should be taken when selecting both the diameter and length of the conductive pin 370, as each affects the half wave resonance of the capacitive structure.

Figure 5F:
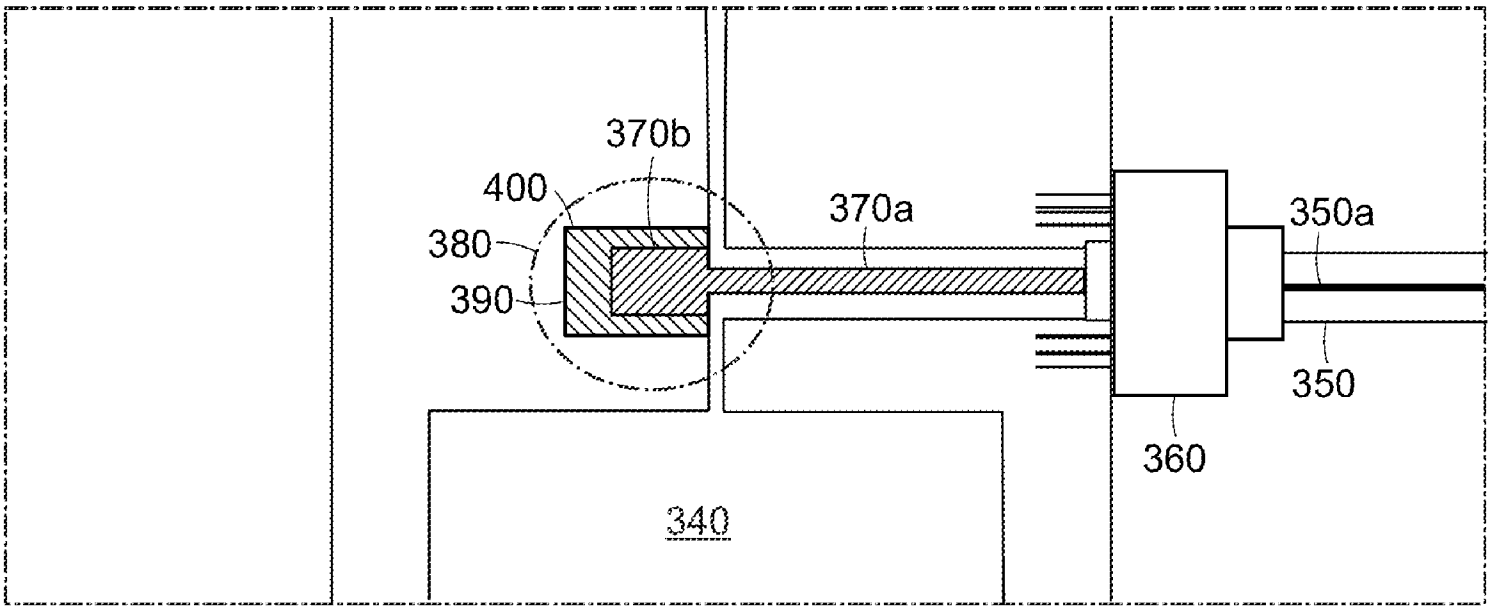
FIG. 5F is a zoomed-in cross-sectional view of the base portion of the dual-ridged horn antenna shown in FIG. 5A, illustrating yet another possible configuration for the conductive feed line (or "conductive pin")

Although a pin formed from a single conductor has greater mechanical stability, some embodiments of the invention may fabricate the conductive pin 370 in a piecemeal fashion. For instance, FIG. 5F shows how the conductive pin 370 may include two conductors, which are formed separately and coupled together (e.g., via soldering). Although this may complicate fabrication, the embodiment shown in FIG. 5F enables the diameter of the terminal end (i.e., the capacitive stub portion 370*b*) to be larger than the rest of the conductive pin (i.e., the portion 370*a* extending through the first ridge and gap). This increases the capacitance provided by the capacitive stub portion 370*b*, while simplifying the connection between the rest of the conductive pin 370*a* and the connector 360.

It is noted that the diameter of portion 370*a* is illustrated in FIG. 5F as being larger than the diameter of center conductor 350*a*. However, one skilled in the art would understand that the diameters of conductors 350*a*, 370*a*, and 370*b* may be selected to simplify fabrication and optimize the impedance matching between center conductor 350*a* and ridges 310.

In some embodiments, the diameter of the conductive pin 370 and/or the hole through which it extends (i.e., the hole extending through the first and second ridges) may be tapered to provide a broadband impedance transformer between the coaxial transmission line 350 and the feed point 380 of horn antenna 300. For example, it may be beneficial (at times) to reduce the gap existing between the ridges 310 of the horn antenna at the feed point. Reducing the gap provides the benefits of suppressing higher order modes in the feed region and reducing the lower end of the operating frequency range (by lowering the cutoff frequency of the TE10 hybrid mode, the desired operating mode, in the dual-ridged waveguide.)

As smaller gaps exhibit lower impedance levels at the feed point, a need arises for a broadband impedance transformer to reduce the coaxial transmission line impedance (typically 50Ω) to a lower level. To obtain such an impedance transformer, one could taper the diameter of conductive pin 370 and/or the hole through which it extends as the pin/hole proceeds from the connector 360 toward the notch 390. The taper could be configured with a smooth or stepped transition. However, the actual implementation of the taper could be realized in a variety of different ways.

Figure 5G:
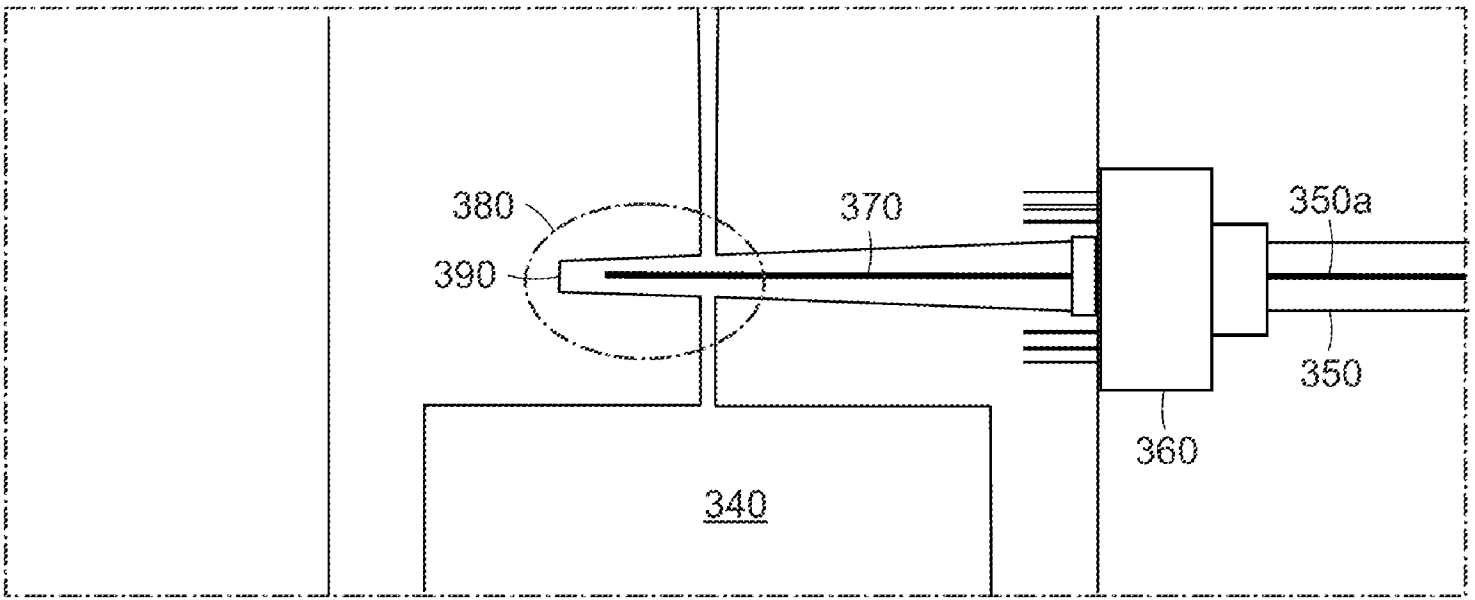
FIG. 5G is a zoomed-in cross-sectional view of the base portion of the dual-ridged horn antenna shown in FIG. 5A, illustrating one embodiment of a tapered hole extending from the connector to the notch.
Figure 5H:
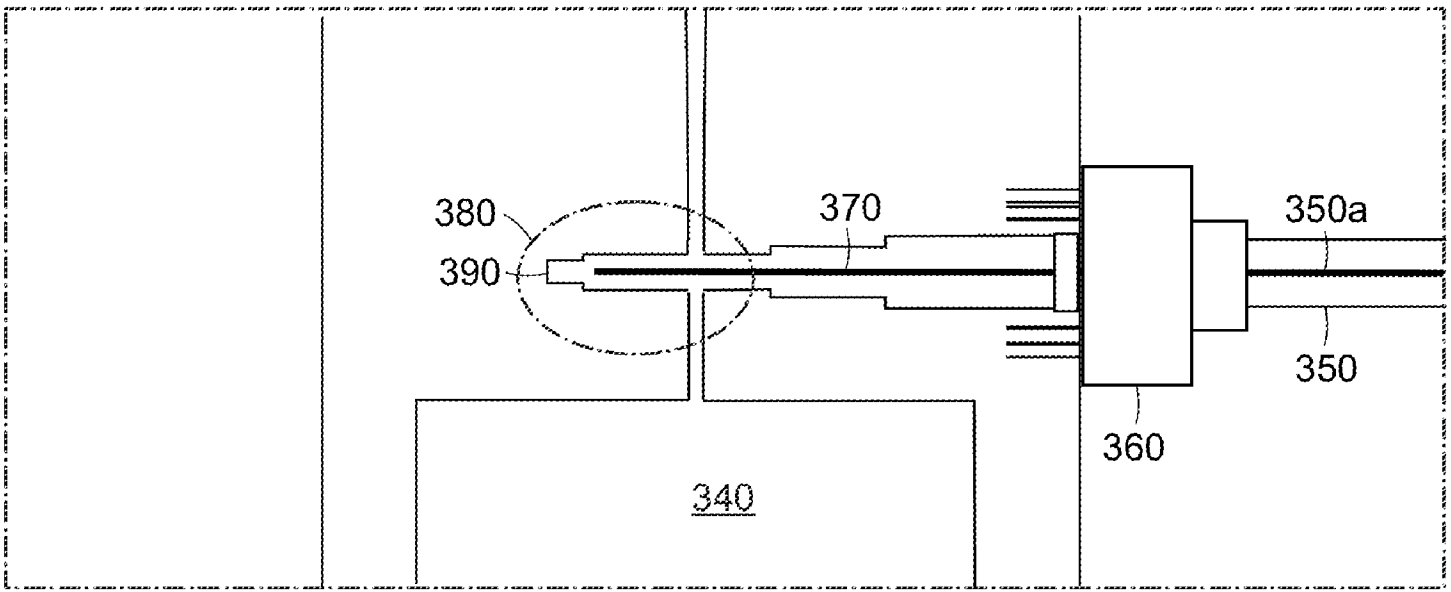
FIG. 5H is a zoomed-in cross-sectional view of the base portion of the dual-ridged horn antenna shown in FIG. 5A, illustrating another embodiment of a tapered hole extending from the connector to the notch.
Figure 5I:
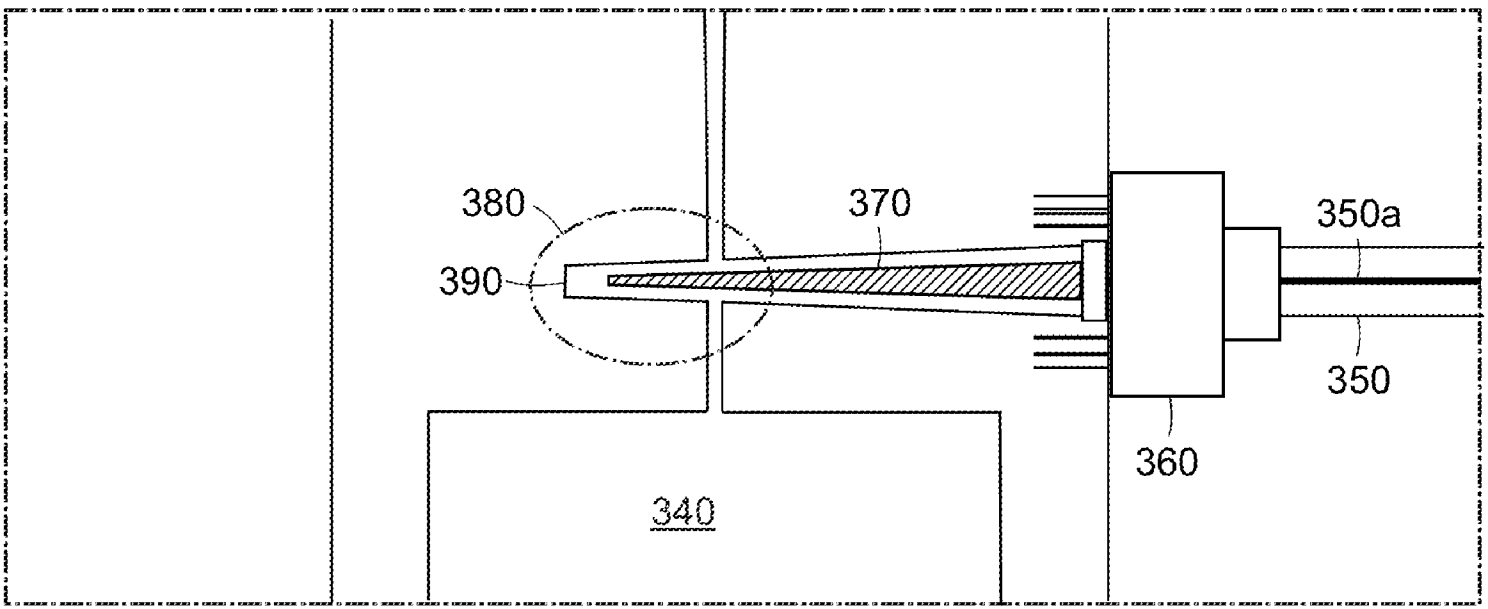
FIG. 5I is a zoomed-in cross-sectional view of the base portion of the dual-ridged horn antenna shown in FIG. 5A, illustrating one embodiment of a tapered hole and a tapered conductive pin extending from the connector to the notch.

Various embodiments of a broadband impedance transformer are illustrated in FIGS. 5G-5I. In particular, FIG. 5G illustrates one manner in which the hole extending from the connector 360 to the notch 390 may be implemented with a relatively smooth transition. FIG. 5H illustrates one manner in which the hole extending from the connector 360 to the notch 390 may be implemented with a stepped transition. FIG. 5I illustrates one manner in which both the hole and the conductive pin 370 are tapered. One skilled in the art would understand how an appropriate amount of impedance transformation may be provided by tapering the conductive pin 370 and/or the hole in a substantially different manner than that explicitly shown herein. In one embodiment, for example, the conductive pin 370 and/or the hole may be tapered in an exponential manner. In another embodiment, only a portion of the conductive pin 370 and/or hole may be tapered. For example, the portion of the conductive pin 370 extending through the first ridge and the gap may be tapered, whereas the portion of the pin arranged within the notch 390 may be substantially uniform. Numerous other possibilities exist for implementing the broadband impedance transformer described herein.

The graphs shown in FIGS. 6A-6D illustrate various improvements provided by dual-ridged horn 300 over those provided by dual-ridged horn 200. The antenna designs used to obtain the graphs shown in FIGS. 6A-6D are substantially identical, with the exception that dual-ridged horn 300 has been modified to include the series capacitance discussed above. Each of the antennas is implemented with a reduced-size cavity to provide acceptable response at the high end of the operating frequency range. Although reducing the size of the cavity behind the feed region necessarily increases the return loss, the size reduction is necessary to provide improved high end performance.

Figure 6A:
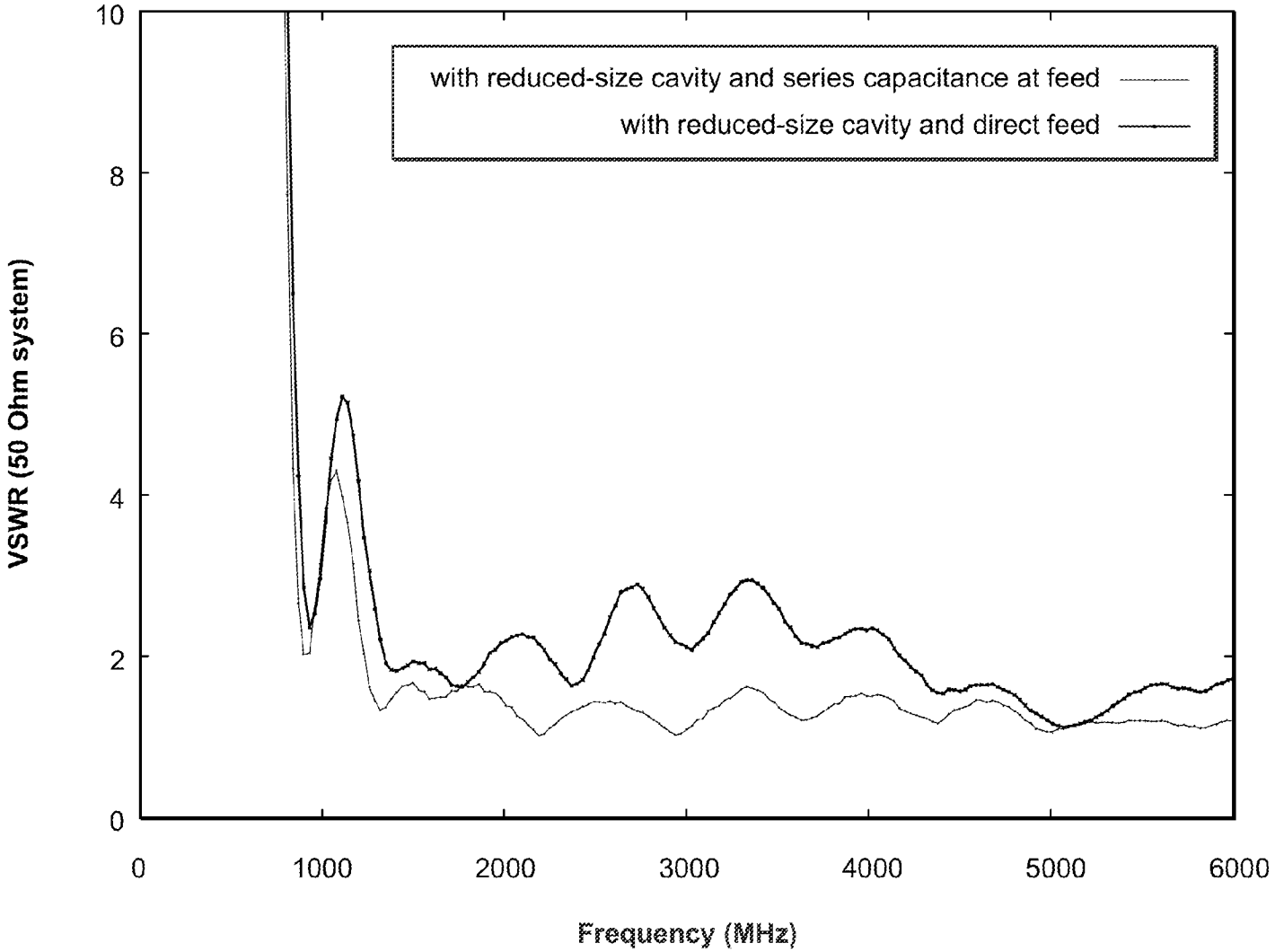
FIG. 6A is a graph illustrating an improvement in the input voltage standing wave ratio (VSWR) provided by the dual-ridged horn antenna shown in FIG. 5A ("with reduced-size cavity and series capacitance at feed") over that provided by the dual-ridged horn antenna shown in FIG. 3A ("with reduced-sized cavity and direct feed")
Figure 6B:
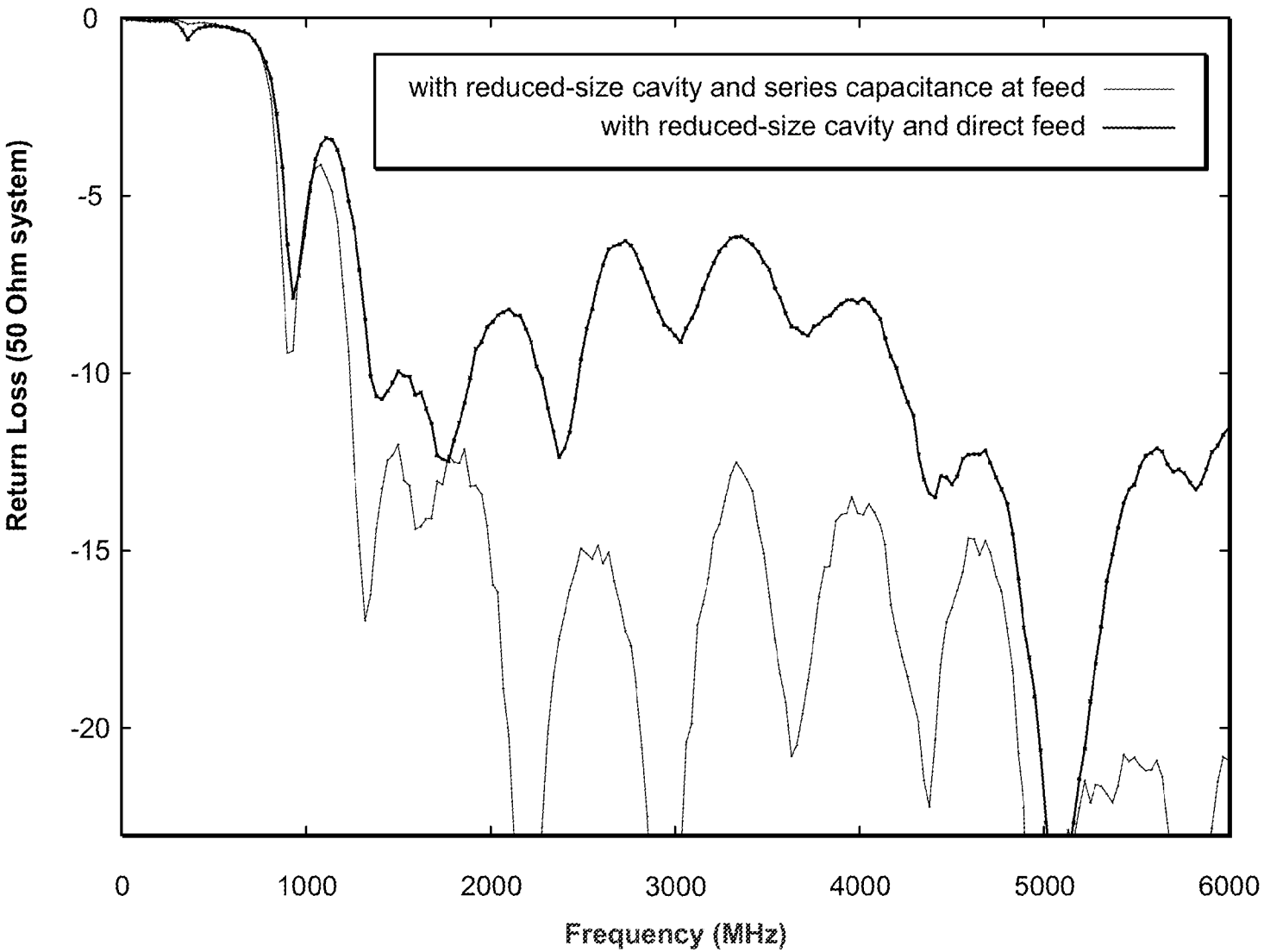
FIG. 6B is a graph illustrating an improvement in the return loss for the dual-ridged horn antenna shown in FIG. 5A ("with reduced-size cavity and series capacitance at feed") over that provided by the dual-ridged horn antenna shown in FIG. 3A ("with reduced-sized cavity and direct feed")

FIGS. 6A and 6B compare the Voltage Standing Wave Ratio (VSWR) and Return Loss (RL) provided by horn antenna 200 ("with reduced-size cavity and direct feed") and horn antenna 300 ("with reduced-size cavity and series capacitance at the feed"). The VSWR and RL are both indications of how much of the power incident on the input port of the horn is reflected. Lower values of VSWR and RL indicate better performance. As shown in FIGS. 6A and 6B, the series capacitance employed at the feed region of horn antenna 300 reduces both the VSWR and the RL.

Figure 6C:
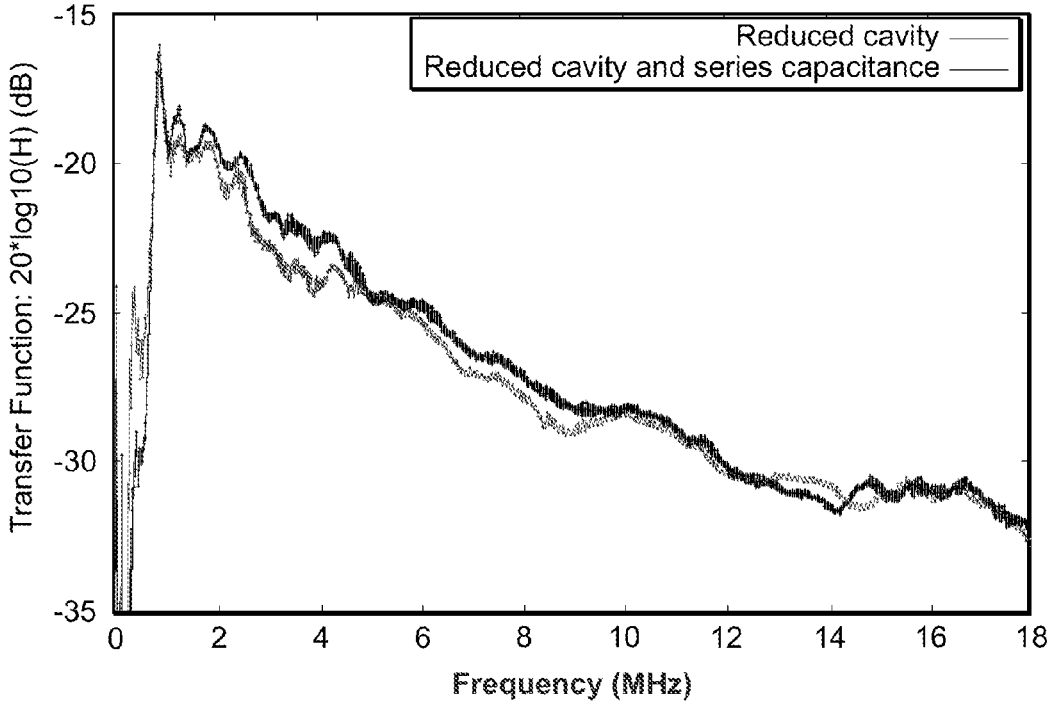
FIG. 6C is a graph illustrating an improvement in the frequency transfer function provided by the dual-ridged horn antenna shown in FIG. 5A ("reduced cavity and series capacitance") over that provided by the dual-ridged horn antenna shown in FIG. 3A ("reduced cavity")
Figure 6D:
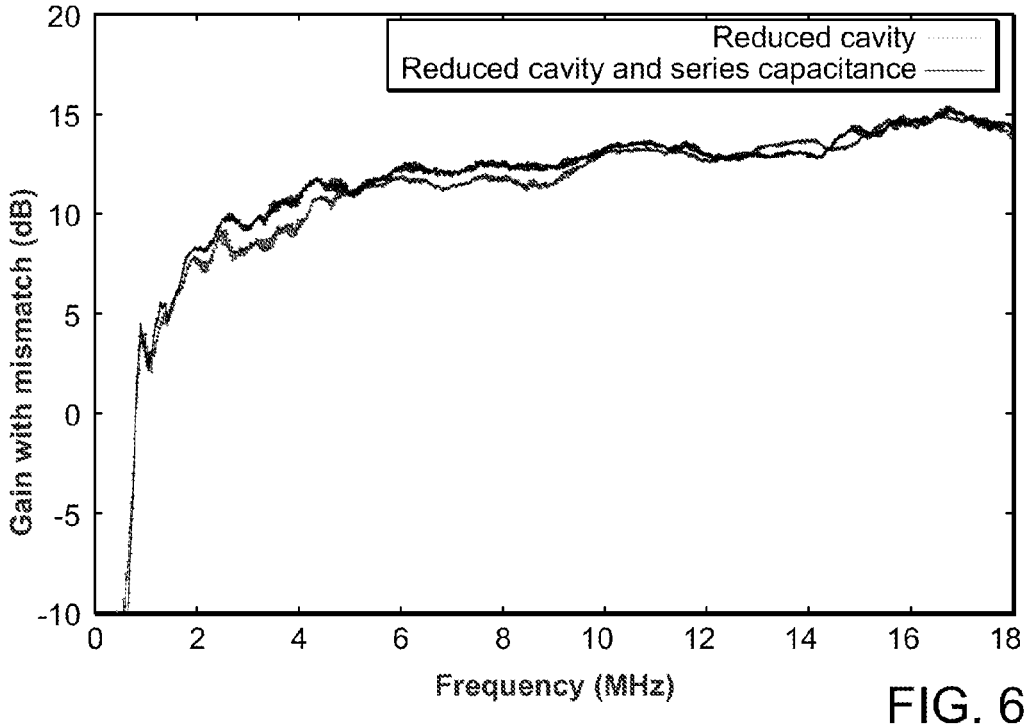
FIG. 6D is a graph illustrating an improvement in the gain provided by the dual-ridged horn antenna shown in FIG. 5A ("reduced cavity and series capacitance") over that provided by the dual-ridged horn antenna shown in FIG. 3A ("reduced cavity")

FIGS. 6C and 6D compare the magnitude of the frequency transfer function and the gain (respectively) provided by dual-ridged horn 300 ("reduced cavity and series capacitance") and dual-ridged horn 200 ("reduced cavity"). As shown in FIG. 6C, the series capacitance utilized within horn antenna 300 provides approximately 1-2 dB improvement across the lower part of the range. The series capacitance also increases the gain over much of the operating frequency range (FIG. 6D). In particular, FIG. 6D shows the amount of "gain with mismatch" provided by each antenna. In comparison with the "gain" mentioned earlier, the "gain with mismatch" ($G_{effective}$) is that gain (G) multiplied by the so-called "matching efficiency," or:

$$G_{effective} = \underbrace{G}_{\substack{gain \\ (IEEE\ definition)}} \cdot \underbrace{(1-|\Gamma|^2)}_{matching\ efficiency} \qquad \text{EQ. 6}$$

$$= \underbrace{D}_{directivity} \cdot \underbrace{\eta}_{\substack{efficiency \\ (thermodynamic)}} \underbrace{(1-|\Gamma|^2)}_{matching\ efficiency}$$

The matching efficiency is unity minus the return loss and indicates how much power is accepted by the antenna. As shown in FIG. 6D, dual-ridged horn antenna 300 provides approximately 1-2 dB more gain (with mismatch) than antenna 200.

Figure 7:
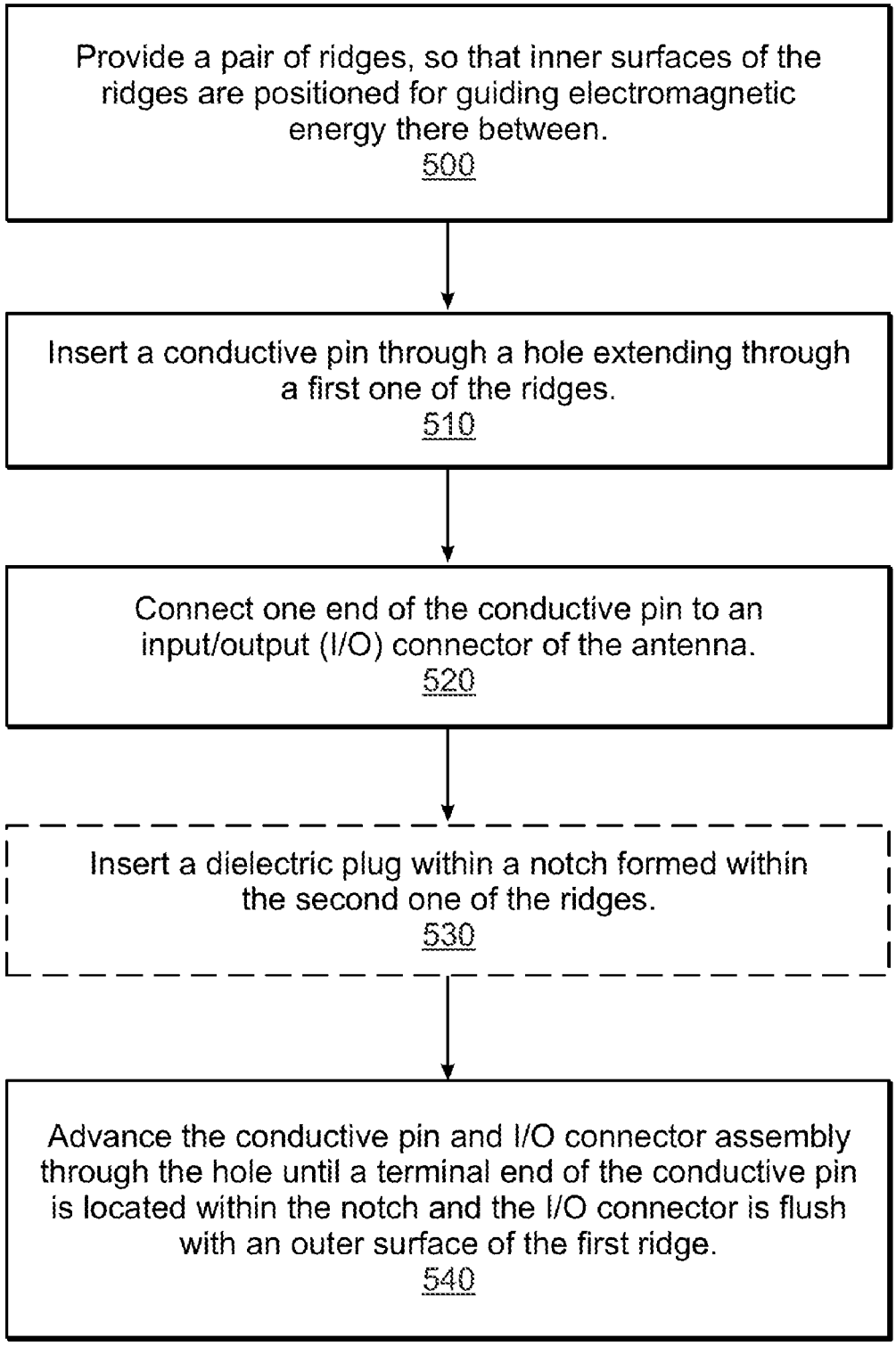
FIG. 7 is a flow chart diagram illustrating one embodiment of a method for fabricating the dual-ridged horn antenna shown in FIG. 5A.

An exemplary method for fabricating a dual- or quad-ridged horn antenna in accordance with the present invention is shown in FIG. 7. In particular, the illustrated method provides one manner in which an impedance matching network may be embedded within the ridge(s) of a dual- or quad-ridged horn antenna. However, one skilled in the art would understand how other methods not specifically mentioned herein may also be used to form a dual- or quad-ridged horn antenna as shown, e.g., in FIGS. 5A-5F.

In some cases, the method may begin 500 by providing a pair of ridges, so that inner surfaces of the ridges are positioned for guiding electromagnetic energy there between. As noted above, the ridges may be constructed as individual conductive plates, which are assembled together in the described manner, or may be formed as a continuous piece of conductive material. In addition, the ridges may be formed from substantially any material and may have substantially any geometry deemed appropriate for "guiding" EM waves through the antenna. In one embodiment, the ridges may be cut or machined from a plate of aluminum having a thickness of about 9 mm. However, it is important to note that the ridges may be formed in accordance with many different fabrication processes (e.g., a casting process may be used, in one embodiment) and materials. The machining process mentioned above represents only one of many different fabrication embodiments.

In some cases, the method may continue 510 by inserting a conductive pin through a hole extending through a first one of the ridges. The hole may be formed in substantially any manner. In one example, the hole may be formed by machining or drilling through the first ridge and into a portion of the second ridge. In another example, the hole may be pre-fabricated within the initial ridge geometry (e.g., when the ridges are initially cut or molded). The conductive pin may include substantially any other conductive material, which exhibits high conductance (especially at the high end of the operating frequency range). In one example, the conductive pin may be fabricated from beryllium copper, which is heat treated to a high temper and then silver plated.

In some cases, the method may continue 520 by connecting one end of the conductive pin to a power connector or input/output (I/O) connector of the horn antenna. For example, the connecting step may include fixedly attaching the one end of the conductive pin to the connector via a soldering, welding or bonding technique. In one embodiment, the one end of the conductive pin may be soldered to a socket, pin or receptacle protruding from the back of an N or APC-3.5 connector. The conductive pin may be connected to the center conductor of the coaxial transmission line by sliding the center conductor into a jack or collet of the connector. However, it is important to note that many other connectors could be used in place of the N or APC-3.5 connector mentioned above. In such embodiments, the conductive pin may be connected somewhat differently to the center conductor of the coaxial transmission line.

In some cases, the method may continue 540 by advancing the conductive pin and connector assembly through the hole until a terminal end of the conductive pin is located within a notch formed within a second one of the ridges and the connector is flush with an outer surface of the first one of the ridges. As noted above, the conductive pin is preferably positioned so that the terminal end provides a capacitive, rather than physical, connection with the ridges. The amount of capacitance provided by the pin may be carefully chosen to minimize impedance mismatch at the feed region and optimize the frequency response of the horn antenna.

In some cases, a desired amount of capacitance may be provided by manipulating a configuration of the conductive pin. As noted above, the conductive pin may comprise a single conductor (see, e.g., FIGS. 5D-5E) or multiple conductors, which are later coupled together to form the conductive pin (see, e.g., FIG. 5F). In some cases, a length and/or diameter of the conductor(s) may be selected to provide the desired amount of capacitance. In some cases, for example, the length of the conductor(s) may be increased (to the extent that the high frequency range is not affected) to reduce the input impedance and increase the capacitance provided by the capacitive stub. In some cases, the diameter of the conductor (s) may be manipulated (in addition to or instead of the length) to provide the desired amount of capacitance. In some embodiments (see, e.g., FIG. 5D), the diameter of the conductive pin may be substantially equal to a diameter of the center conductor included within a coaxial transmission line. In other embodiments (see, e.g., FIGS. 5E-5F), the diameter of the conductive pin may be made substantially larger than the diameter of the center conductor to increase the capacitance provided by the capacitive stub. In one embodiment, a relationship between the inner and outer conductor diameters, as well as the relative permittivity of the dielectric, may be selected to match the input impedance of the horn antenna to a 50 Ohm coaxial transmission line.

In some cases, one or more steps may be performed prior to the step of advancing. In one example, the method may include an optional step 530 of inserting a dielectric material or "dielectric plug" within the notch formed within the second one of the ridges. As noted above, the dielectric material may be confined within the notch, or may extend from the connector, through the first ridge and into the notch formed within the second ridge. In either case, the dielectric material may be configured to secure the terminal end of the conductive pin within the notch and prevent physical contact between the conductive pin and the ridges.

If included, the dielectric material may also increase the capacitance provided by the "capacitive stub" (i.e., the terminal end of the conductive pin embedded within the notch). Although a broad range of dielectric materials may be used, most embodiments of the invention may prefer a dielectric material having a relative permittivity greater than about 2.0. Possible candidates for the dielectric material include synthetic fluoropolymers (e.g., PTFE), cross-linked polystyrenes (e.g., Rexolite) and ceramic materials (e.g., alumina, beryllia, or barium titanate). Other dielectric materials not specifically mentioned herein may also be used.

Various embodiments of a horn antenna having an improved frequency response, as well as methods for making such a horn antenna, have now been described. In brief, the horn antenna and method described herein improves upon conventional antenna designs by embedding an impedance matching network with at least one "ridge" of a dual- or quad-ridged horn antenna. The impedance matching network is implemented, in a preferred embodiment, as an "open-circuit transmission line stub" or "capacitive stub." The capacitive stub may be configured in a variety of ways to provide an amount of capacitance needed to reduce or eliminate impedance mismatch at the feed, thereby improving and/or extending the operating frequency range of the horn antenna.

In some cases, the impedance matching network set forth herein may be combined with one or more additional improvements. As noted above, for example, the size of the cavity structure may be decreased to extend the upper frequency response (e.g., past the 18 GHz upper frequency limit shown in FIG. 6C). Since the size of the cavity affects the lower frequency response, the capacitance provided by the capacitive stub may be increased to maintain a desirable lower frequency limit (e.g., about 800 MHz, as shown in FIG. 6C). Alternative means for extending the upper frequency response may also be used.

As noted above, the lower end of the operating frequency range may be extended, in some embodiments, by reducing the gap between the ridges 310 of the horn antenna 300. However, reducing the gap size lowers the overall input impedance of the horn antenna, and necessitates the need for an impedance transformer (i.e., to lower the impedance (typically 50Ω) of the coaxial transmission line to a lower level). As set forth above, the diameter of the conductive pin 370 and/or the hole through which it extends could be tapered (e.g., with a smooth or stepped transition) to provide an appropriate amount of impedance transformation.

In some cases, the impedance matching network set forth herein may be combined with one or more of the improvements set forth in commonly-owned U.S. Pat. No. 7,161,550. For example, the impedance matching network may be combined with: (i) tapered extension elements at the mouth of the antenna, (ii) magnetically loaded ridges, (iii) longitudinal grooves formed within the ridges, (iv) a magnetically loaded cavity, and/or (v) the use of a complementary, balanced feed for supplying equal and opposite amounts of current to the ridges. Combining one or more of these improvements within the currently disclosed impedance matching network may result in a dual- or quad-ridged antenna with superior operating bandwidth and radiation characteristics. In some cases, impedance matching network may be combined with other improvements not specifically mentioned herein.

In some cases, impedance matching network set forth herein may be implemented somewhat differently than the manner described herein. In one alternative embodiment, the capacitive stub described above may be replaced with an "off-the-shelf" capacitor, such as a multi-layer chip capacitor, which is inserted between the coaxial transmission line and the ridges at the feed region. Although the substitution sounds trivial, the connections to the chip tend to exhibit a small parasitic behavior, which may limit the upper frequency range of the horn antenna.

It will be appreciated to those skilled in the art having the benefit of this disclosure that this invention is believed to provide a dual-ridged and quad-ridged horn antenna with an embedded impedance matching network configured for maximizing the operating frequency range. Further modifications and alternative embodiments of various aspects of the invention will be apparent to those skilled in the art in view of this description. It is intended, therefore, that the following claims be interpreted to embrace all such modifications and changes and, accordingly, the specification and drawings are to be regarded in an illustrative rather than a restrictive sense.

What is claimed is:

1. A horn antenna, comprising:

a pair of ridges arranged opposite one another for guiding an electromagnetic wave there between;

a transmission line coupled to a first one of the ridges for supplying power to, or receiving a signal from, a feed region of the horn antenna; and an impedance matching network embedded within a second one of the ridges at the feed region for reducing an impedance mismatch between the transmission line and the ridges.

2. The horn antenna as recited in claim 1, wherein the impedance matching network is configured to provide a series capacitance between the transmission line and the ridges at the feed region.

3. The horn antenna as recited in claim 2, wherein the impedance matching network comprises a conductive pin, which extends from the transmission line, through the first ridge and into a notch formed within the second ridge.

4. The horn antenna as recited in claim 3, wherein a diameter of the conductive pin is larger than a diameter of a center conductor of the transmission line.

5. The horn antenna as recited in claim 3, wherein a diameter of the conductive pin tapers in a smooth or stepped fashion as it extends from the transmission line, through the first ridge and into the notch formed within the second ridge.

6. The horn antenna as recited in claim 3, wherein the impedance matching network further comprises a dielectric material for: (i) securing the conductive pin at the feed region, (ii) preventing physical contact between the conductive pin and the ridges, and (iii) increasing the series capacitance.

7. The horn antenna as recited in claim 6, wherein the dielectric material extends from the transmission line, through the first ridge and into the notch formed within the second ridge.

8. The horn antenna as recited in claim 6, wherein the dielectric material is confined within the notch for encasing a terminal end of the conductive pin.

9. A horn antenna, comprising:

a pair of ridges arranged opposite one another for guiding an electromagnetic wave there between;

a conductive pin extending from an input/output (I/O) connector on the horn antenna, through a first one of the ridges and into a notch, which is formed within a second one of the ridges at a feed region of the horn antenna; and a dielectric material configured for securing a terminal end of the conductive pin within the notch and preventing physical contact between the conductive pin and the ridges.

10. The horn antenna as recited in claim 9, wherein the dielectric material extends from the I/O connector, through the first ridge and into the notch formed within the second ridge.

11. The horn antenna as recited in claim 9, wherein the dielectric material is confined within the notch.

12. The horn antenna as recited in claim 9, wherein the conductive pin comprises a center conductor of a coaxial transmission line coupled to the I/O connector.

13. The horn antenna as recited in claim 9, wherein the conductive pin is distinct from, but attached to, a center conductor of a coaxial transmission line coupled to the I/O connector.

14. The horn antenna as recited in claim 13, wherein the conductive pin comprises a continuous conductor having a diameter, which is greater than a diameter of the center conductor.

15. The horn antenna as recited in claim 13, wherein the conductive pin comprises:

a first portion, which extends from the I/O connector, through the first ridge and up to a boundary of the notch;

a second portion directly connected to the first portion and confined within the notch; and wherein a diameter of the second portion is larger than a diameter of the first portion.

16. The horn antenna as recited in claim 9, wherein the conductive pin is arranged within through a hole extending from the I/O connector, through the first ridge and into the notch formed within the second ridge.

17. The horn antenna as recited in claim 16, wherein a diameter of the conductive pin tapers in a smooth or stepped fashion as it extends from the I/O connector, through the first ridge and into the notch formed within the second ridge.

18. The horn antenna as recited in claim 16, wherein a diameter of the hole tapers in a smooth or stepped fashion as it extends from the I/O connector, through the first ridge and into the notch formed within the second ridge.

19. The horn antenna as recited in claim 16, wherein a diameter of the conductive pin and a diameter of the hole each taper in a smooth or stepped fashion as they extend from the I/O connector, through the first ridge and into the notch formed within the second ridge.

20. A method for fabricating a horn antenna, the method comprising:

providing a pair of ridges, so that inner surfaces of the ridges are positioned for guiding electromagnetic energy there between;

inserting a conductive pin through a hole extending through a first one of the ridges;

connecting one end of the conductive pin to an input/output (I/O) connector; and advancing the conductive pin and I/O connector assembly through the hole until a terminal end of the conductive pin is located within a notch formed within a second one of the ridges and the I/O connector is flush with an outer surface of the first one of the ridges.

21. The method as recited in claim 20, wherein the connecting step comprises fixedly attaching the one end of the conductive pin to the I/O connector via a soldering, welding or bonding technique.

22. The method as recited in claim 20, wherein a diameter of the conductive pin is larger than a diameter of a center conductor of a transmission line coupled to the I/O connector.

23. The method as recited in claim 20, wherein prior to the advancing step, the method comprises tapering a diameter of the conductive pin and/or a diameter of the hole.

24. The method as recited in claim 20, wherein prior to the advancing step, the method comprises inserting a dielectric plug within the notch formed within the second one of the ridges, wherein the dielectric plug is configured for securing the terminal end of the conductive pin within the notch and preventing physical contact between the conductive pin and the ridges.

25. The method as recited in claim 20, wherein the dielectric plug is selected from a group of dielectric materials having a relative permittivity greater than or equal to about 2.0.

26. The method as recited in claim 20, wherein the dielectric plug is selected from a group of dielectric materials comprising synthetic fluoropolymers, cross-linked polystyrenes and ceramic materials.

* * * * *